US007534324B2

(12) United States Patent
Pease et al.

(10) Patent No.: US 7,534,324 B2
(45) Date of Patent: May 19, 2009

(54) FELT AND EQUIPMENT SURFACE CONDITIONER

(75) Inventors: Jacqueline K. Pease, St. Augustine, FL (US); G. Gunar McKendree, Jacksonville, FL (US)

(73) Assignee: Hercules Incorporated, Wilmington, DE (US)

( * ) Notice: Subject to any disclaimer, the term of this patent is extended or adjusted under 35 U.S.C. 154(b) by 456 days.

(21) Appl. No.: 11/472,754

(22) Filed: Jun. 22, 2006

(65) Prior Publication Data

US 2007/0017648 A1 Jan. 25, 2007

Related U.S. Application Data

(60) Provisional application No. 60/693,724, filed on Jun. 24, 2005.

(51) Int. Cl.
*D21F 1/32* (2006.01)

(52) U.S. Cl. ..... 162/199; 162/272; 162/DIG. 4; 162/72; 134/15; 134/26

(58) Field of Classification Search ..... None
See application file for complete search history.

(56) References Cited

U.S. PATENT DOCUMENTS

| | | | | |
|---|---|---|---|---|
| 4,715,931 | A | 12/1987 | Schellhamer et al. | 162/199 |
| 4,861,429 | A | 8/1989 | Barnett et al. | 162/199 |
| 4,895,622 | A | 1/1990 | Barnett et al. | 162/72 |
| 4,997,523 | A * | 3/1991 | Pease et al. | 162/5 |
| 5,223,097 | A | 6/1993 | Hassler | 162/161 |
| 6,524,435 | B1 | 2/2003 | Agarwal et al. | 162/1 |
| 6,558,513 | B1 | 5/2003 | Pease et al. | 162/173 |

* cited by examiner

*Primary Examiner*—Mark Halpern
(74) *Attorney, Agent, or Firm*—Joanne Mary Fobare Rossi

(57) ABSTRACT

Deposition of contamination by deposits of resinous material on paper making equipment is undesirable. This invention prevents or retards such contamination by treating the equipment, especially the press felts with a composition containing a polyoxyalkylene. surfactant which contains units of ethylene oxide and a higher alkylene oxide.

8 Claims, No Drawings

FELT AND EQUIPMENT SURFACE CONDITIONER

This application claims the benefit of U.S. Provisional Application No. 60/693,724, filed Jun. 24, 2005, which is hereby incorporated herein by reference in its entirety.

BACKGROUND OF THE INVENTION

1. Field of the Invention

The present invention relates to methods of treating paper making equipment, including felts and fabrics, to eliminate or reduce the need to shut-down and clean such equipment. More specifically the invention relates to continuous or intermittent treatment of papermaking equipment with a composition containing at least one nonionic surfactant that contains units of ethylene oxide (EO) and of a higher alkylene oxide (AO), alone or in combination with an anionic dispersant or sequestering agent to inhibit deposition.

2. Discussion and Background

Paper is produced in a continuous manner from a fibrous suspension (pulp furnish) generally made of water and cellulose fibers. A typical paper manufacturing process consists of 3 stages: forming, pressing, and drying. In the forming stage, the dilute pulp furnish is directed on a forming fabric or between two fabrics. The majority of the water is drained from the pulp furnish, through the fabric, creating a wet paper web. In the pressing stage the paper web comes in contact with one or generally more porous press felts that are used to extract much of the remaining water from the web. Often the pickup felt is the first felt that the wet web contacts which is used to remove the web from the forming fabric, via a suction pickup roll positioned behind the felt, and then to transport the web to the rest of the press section. The web then generally passes through one or more presses each consisting of two press elements such as rotating press rolls and/or stationary elements such as extended nip or shoe presses. The two press elements are positioned in close proximity to each other forming, what is commonly referred to as, a press nip. In each nip the paper web comes in contact with either one or two press felts where water is forced from the web and into the press felt via pressure and/or vacuum. In single-felted press nips the web is in contact with the press roll on one side and the felt on the other. In double-felted press nips, the web passes between the two felts. After the press section, the paper web is dried to remove the remaining water, usually by weaving through a series of steam heated dryer cans.

Press felts are normally an endless loop that circulates continuously in a belt-like fashion between sheet contact stages and return stages. Various felt carrier rolls are used to keep the felt loop rotating through these stages. Water pulled into the felt from the paper web at the nip is generally removed from the felt by vacuum during the felt return stage at, what is frequently referred to as, the uhle box. The uhle box is also sometimes called the felt suction pipe, or the suction box. The uhle box cover is commonly made of materials such as ceramic or high molecular weight polyethylene with openings often in slots or herringbone patterns through which vacuum is applied to the felt. Generally lubrication shower water is applied to the felt just prior to where the felt contacts the uhle box to reduce friction on the felt and cover surfaces.

Press felts often consist of nylon base fabric generally made of from 1 to 4 individual layers of filaments arranged in a weave pattern. An extruded polymeric membrane or mesh can also be included as one or more of the base fabric layers. Batt fibers, of smaller diameter than the base fabric filaments, are needled into the base on both sides giving the felt a thick, blanket-like appearance. Press felts are designed to quickly take in water from the web in the nip and hold the water so that it does not re-absorb back into the sheet as the paper and felt exit the press nip. Press felts are designed to efficiently remove water from the paper web, however, the press felt design also tends to be a trap for materials that are dissolved or suspended in the liquid coming from the paper web, causing these materials to build-up on or within the felt structure.

It is common for materials that build-up in the press felt to transfer from the felt to other press section surfaces and to form deposits on these surfaces. For example uhle box deposition is a problem that is often associated with newsprint manufacture. Newsprint is made from pulp that is high in resinous/sticky contaminants. The resins tend to transfer from the felt to the uhle cover, where deposits build to a point where the uhle box can no longer pull a vacuum on the felt. Such resin build-up forces the paper maker to routinely shut-down the paper machine to clean the deposit from the cover. Other equipment surfaces within the press section where problematic deposits can build include press rolls, doctor blades used to clean press rolls, felt carrier rolls, and press belts. Press belts are used on stationary types of presses (shoe and extended nip) such that the belt separates the felt from the stationary element.

It is important for efficient paper production, that press felts remain deposit-free. Deposits that form on press felts such as oily or sticky materials can transfer back to the web resulting in dirt spots or holes in the finished paper. They can also cause paper breaks or tears leading to lost production. It is also important for efficient paper production, that press felts remain porous with high void volume. It is highly expensive and energy intensive to evaporate water from paper in the dryer section, making it critical that the press felts remove as much water as possible from the paper web in the press section. Felts that become filled with contaminants that limit water movement through the felt will thus limit the amount of water that can be removed from the web. This will force the machine speed to be slowed in order to allow time for the web to dry in the dryer section. Felts that are unevenly filled can also lead to uneven water removal from the sheet which can result in moisture streaks, wrinkles, and web breaks.

It is also highly important for efficient paper production, that the other equipment surfaces within the press section remain free of deposits. In particular deposits that form on the uhle box covers can impede water removal from the felt and thus limit water removal by the felt from the paper web. Deposits can also build to a point where they break off and transfer back to the felt and to the web leading to web breaks and lost production. Deposition on the uhle cover, carrier rolls, and press rolls can also lead to excessive wear of the nylon fibers in the felt resulting in premature removal. Press section deposition can cause down time necessary for cleaning resulting in significant losses in production time.

Some of the dissolved or suspended materials that are present in the web that can deposit in the press section include components originating from pulp such as wood pitch including resin acids, fatty acids, and fatty esters and stickies from recycled pulp including inks, glues, resins, latexes, and waxes. Carryover of processing additives used in the pulp mill can also lead to press section deposition such as sodium silicates commonly added during mechanical pulp and deinked pulp bleaching; and carryover of deink plant flotation collectors. Cellulose fines and hemicelluloses can also add bulk to the deposits. Byproducts of microbiological growth such as polysaccharides, proteins, and other biological matter, can deposit in the press section. Various functional additives that are added to paper stock to impart certain properties to the finished paper can deposit in the press section. These additives include sizes such as rosin, alkyl ketene dimer (AKD), and alkenyl succinic anhydride (ASA); wet strength resins and dry strength agents; and inorganic fillers including clay, talc, precipitated or ground calcium carbonate (PCC, GCC), and titanium dioxide. Processing additives used to improve or limit problems during paper production that can deposit in the press section include retention and drainage aids such as alum, organic polymers, and various microparticles; and defoamers, in particular those based on oil.

It is well known that felt conditioners enhance the performance and extend the effective life of felts by inhibiting the materials mentioned above from filling the void volume in press felts. Felt conditioners are usually liquid blends of surfactants, dispersants and/or polymers most often in water but other solvents are also utilized. Oxidizers, acids, and alkalis can also be contained in felt conditioners, generally in relatively low concentrations. Felt conditioners are applied continuously or intermittently to papermaking felts while paper is being produced through showers during the fabric return stage, while the felt is not in contact with the paper web. These treatments are most often applied on the inside, or machine side, of the felt through low pressure showers, often just prior to a felt carrier roll such that hydraulic force will help move the chemical into the felt to help prevent and remove contaminants that fill the felt. Such treatments are also sometimes applied, through similar showers on the sheet side of the felt after the uhle box and before the nip so that the treatment is present on the surface when contaminants first reach the felt. Additional water showers that are commonly used on press felts and in which chemicals could be applied include high pressure showers that are usually employed intermittently, so as not to damage the felt, and are most often used on the sheet side to remove surface contaminants. Lubrication showers are also commonly used to apply water at the entrance to the uhle box to prevent wear and provide a seal so that vacuum can remove fluid from within the felt.

When the felts become too filled that they no longer allow for efficient paper manufacture, it becomes necessary to clean them by a process commonly referred to as batch cleaning. When felts are batch cleaned, paper production is stopped, the felt speed is generally slowed, the vacuum at the uhle box is stopped or significantly reduced, and showers are turned off with the exception of the chemical shower. A cleaning solution, generally consisting of high concentrations of caustic, acid, solvent such as kerosene, and/or oxidizer such as hypochlorite, is applied through the chemical shower. After sufficient time for the cleaning solutions to penetrate the filling material, water showers are employed such that the contaminants and batch cleaning chemicals are removed from the felt by vacuum at the uhle box. It is generally necessary to remove the batch cleaning chemicals from the press felt because these materials, at the high concentrations utilized, can damage the press felt if allowed to remain on the felt or can transfer back to the paper altering its characteristics. In some instances it may be necessary to batch clean felts multiple times in a 24-hour production day. Batch cleaning is often necessary, but not a desirable solution since the chemicals used are often hazardous, environmentally unfriendly, and can damage the felt with repeated use. Valuable production time is lost during shut-downs for batch cleaning. If such cleaning is unsuccessful, it is necessary to remove the felt, sometimes prematurely, from the paper machine, which is costly from both a time and material perspective.

Deposits that form on press section equipment are not always prevented effectively by felt conditioners. Felt batch cleaners, used to clean the felt, do not always adequately remove the deposits formed on other press section surfaces, and the felt may not always need to be cleaned when other press section surfaces need to be cleaned. It is often necessary to shut-down the paper machine and physically remove the deposits by scraping or some other cleaning means, sometimes multiple times during a shift. This is a common method for maintaining uhle covers for mills producing grades high in resinous pitch. Such cleaning cannot take place during a felt batch cleaning since the batch cleaning chemicals are hazardous and the felt is rotating too closely to the equipment surfaces. It is therefore necessary to extend the time of the shut-down to clean the uhle covers after the felt has been cleaned, causing further losses in production.

Continuous and intermittent felt conditioners have been successful at reducing felt filling and increasing time between batch cleanings. However there is still a need for press section conditioners that not only prevent deposition within felts but also prevent deposition on other equipment surfaces within the press section. This is particularly the case where paper high in resinous or sticky contaminants is being produced. There is a need in the paper industry to provide press section conditioners that passivate equipment surfaces to prevent deposition from forming while also preventing the felt from becoming filled.

Treatments applied to the felt or more particularly to treat equipment surfaces have minimal time (seconds) to passivate the surfaces prior to the introduction of new contaminant as well as new dilution/shower water introduction. This is quite different then the action of treatments applied to act on the contaminants to disperse them, thereby preventing deposition. In such instances significantly more time (several minutes) is available for the action to take place then is available when treating press section equipment.

There still exists a need in the industry to provide a press section conditioner that has improved performance at passivating equipment surfaces such as the uhle box to prevent deposition or inhibits contaminants from filling press felts to enhance the effective life of such felts.

SUMMARY OF THE INVENTION

The present invention is directed to methods for reducing or inhibiting deposition on press section equipment and on or within press felts to reduce or eliminate the need for batch cleaning. In use the present invention treats press felts to inhibit deposition or filling on or within the felt structure and to inhibit deposition from forming on the surfaces in which the press felt comes in contact, such as uhle box covers, felt carrier rolls, press rolls, and press belts. Additionally the invention is useful to treat equipment surfaces of papermaking or paper converting processes where deposition prevention is important. Examples of such equipment surfaces include lump-breaker rolls, couch rolls, press rolls, press belts, calender rolls, dryer cans, doctor blades, dryer fabrics, felt and fabric carrier rolls, corrugating fluting rolls and printing presses. More specifically the invention is useful for applying solutions containing at least one polyoxyalkylene surfactant in which the polyoxyalkylene contains repeating units of both ethylene oxide (EO) and of a higher alkylene oxide (AO), continuously or intermittently, to press felts to substantially inhibit substances from filling the void volume of press felts and to inhibit deposits from forming on press equipment surfaces that are in contact with the press felt, such as the uhle box. The solution can be applied continuously or intermittently to paper making felts through the usual showers employed in the paper making process.

An anionic dispersant and/or sequestering agent can additionally be applied as part of a composition with the polyoxyalkylene surfactant containing repeating units of both EO and AO.

The polyoxyalkylene surfactant contains EO and AO units that are random or that are in blocks within the polyoxyalkylene chain(s). AO carbons can range from 3 to 6. Preferred examples of AO include propylene oxide (PO) and butylene oxide (BO). Any hydrophobe used to produce an EO-surfactant can be used to produce the EO/AO-surfactants of the invention. The EO/AO-surfactants can also be copolymers of EO and AO without an additional hydrophobe. Specific types of preferred EO/AO-surfactants include alcohol alkoxylates, EO/PO block copolymers, ethylenediamine tetra EO/PO copolymers, and polydimethyl siloxane with pendent EO/PO polyethers.

The solutions containing the polyoxyalkylene surfactant containing repeating units of both EO and AO can additionally be applied to other paper making equipment surfaces to prevent deposition. Examples of such equipment surfaces include lump-breaker rolls, couch rolls, press rolls, press belts, calender rolls, dryer cans, doctor blades, dryer fabrics, felt and fabric carrier rolls, corrugating fluting rolls and printing presses.

DETAILED DESCRIPTION OF THE INVENTION

Unless otherwise stated, all percentages are by weight. Unless otherwise stated, when an amount or concentration is given as a list of upper and lower preferable values, this is to be understood as specifically disclosing all ranges formed from any pair of an upper preferred value and a lower preferred value, regardless of whether the ranges are separately disclosed.

The surfactants of the subject invention have repeating units of ethylene oxide (EO) and of a higher alkylene oxide (AO). Such surfactants will be referred to here as EO/AO-surfactants or for more specific types, for example, as EO/PO-surfactants.

Traditional ethoxylated surfactants, that do not contain repeating units of a higher alkylene oxide, will be referred to here as EO-surfactants.

Unless other wise stated, the terminology of "EO/AO" or "EO/PO" is intended only to mean that both EO and AO components are contained within the polyoxyalkylene chains within the surfactant. The terminology "EO/AO" is intended to cover situations in which the individual EO and AO units occur randomly within the polyoxyalkylene chain as well as when the EO and AO units exist in well defined blocks within the chain. The terminology "EO/AO" is not intended to suggest any particular organization or order of EO and AO units within the polyoxyalkylene chain. For example, "EO/AO" does not mean that the polyalkoxylene chain must begin with EO and end with AO units.

The invention provides a method of inhibiting substances from filling or forming deposits on or within press felts and for inhibiting substances from depositing on equipment surfaces by applying to said felt and/or equipment surfaces an effective inhibiting amount of a composition containing one or more EO/AO-surfactants. The present method is advantageous over other methods in that it provides improved control of deposition on equipment surfaces that come in contact with the press felt.

In another aspect, the invention provides a method of inhibiting substances from filling or forming deposits on or within press felts and for inhibiting substances from depositing on equipment surfaces by applying to said felt and/or equipment surfaces an effective inhibiting amount of a composition comprising (a) one or more anionic dispersants and/or sequestering agents and (b) one or more EO/AO-surfactants. Preferably the composition is a liquid containing about 1 to 99% by weight of one or more anionic dispersants and/or sequestering agents and about 1 to 99% by weight of one or more EO/AO-surfactants. More preferably the composition is a liquid comprising about 1 to 50% of one or more anionic dispersants and/or sequestering agents and about 5 to 90% of one or more EO/AO-surfactants. Most preferably the composition is a liquid comprising about 5 to 30% of one or more anionic dispersants and/or sequestering agents and about 10 to 50% of one or more EO/AO-surfactants.

In a preferred aspect, the invention provides a method of inhibiting substances from filling or forming deposits on or within press felts and for inhibiting substances from depositing on equipment surfaces by applying to said felt and/or equipment surfaces an effective inhibiting amount of an aqueous composition. The preferred aqueous composition being comprised of 1 to 50% ethylenediamine tetra EO/PO, 1 to 50% alcohol EO/PO and/or EO-PO-EO block copolymer, and 0 to 30% of one or more anionic dispersants and/or sequestering agents. The compositions of the invention are applied to the felt and/or press section equipment using an aqueous shower. The concentration of the EO/PO surfactants within the shower is from about 1 ppm to 2000 ppm. based on weight of volume of shower.

In any embodiment or aspect of the invention the composition containing one or more EO/PO-surfactants can contain additional components. Examples of such additional components include, but are not limited to: other surfactants, formulations aids, stabilizers, enzymes, and/or preservatives.

Any EO/AO-surfactant that can be applied as a liquid to the press felt and/or press section equipment surfaces such that the EO/AO-surfactant will act to inhibit substances from depositing on or filling the felt and/or will act to inhibit substances from depositing on the equipment surfaces falls within the scope of this invention.

Polyoxyethylene chains are formed by breaking the epoxide ring in ethylene oxide (EO) to form the chain having the desired number of repeating EO units (—CH2CH2O—). Any higher alkylene (3C or greater) capable of forming an oxide should therefore be able to react in such a manner as to form a polyoxyalkylene chain and would fall within the scope of this invention. According to *Kirk-Othmer Encyclopedia of Chemical Technology* (Copyright 1997 John Wiley & Sons, Inc., 4th Edition, Volume 23, Surfactants), examples of higher alkylenes that react with active oxygen in a manner analogous to that of ethylene oxide include propylene, butylene, styrene, and cyclohexene. Polyoxyalkylene chains based on any of these examples of higher alkylene oxides would fall within the scope of this invention.

Formula 1 shows the basic structure of the repeating AO groups within the polyoxyalkylene chains of the surfactant.

Formula 1

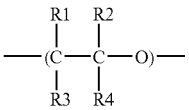

In one preferred embodiment the AO repeating units have at least one C1-C6 alkyl or cyclic group pendent the chain per AO unit, meaning in formula 1 at least one of R1-R4 is C1-C6 with the rest of the remaining R groups being hydrogen.

It is preferred that the AO groups are propylene oxide (PO) or butylene oxide (BO). It is most preferable that the higher alkylene oxide units in the polyoxyalkylene chains are PO. The structure of the repeating propylene oxide unit is shown in Formula 1a. The structures for butylene oxide repeat units are shown in Formula 1b-1d.

Formula 1a

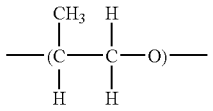

Formula 1b

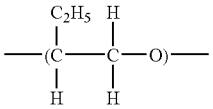

Formula 1c

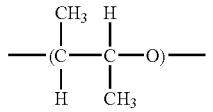

Formula 1d

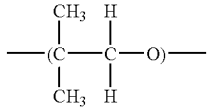

The EO/AO-surfactants of the invention can contain one or more EO/AO chains per molecule, and if desired, one or more hydrophobic groups. For example the surfactant could consist of (EO/AO)-R-(EO/AO), or R-(EO/AO)-R, where R refers to a hydrophobic group. Materials such as glycerols and amines provide multiple sites for EO/AO chain attachment. The EO/AO chains can also be part of a polymer such that the EO/AO units are in blocks within the polymer or are pendent to the polymer chain. Any of the hydrophobic group types that are used to create EO-surfactants can be used to produce the EO/AO-surfactants of the invention. Examples of such the hydrophobic groups include linear or branched alcohols, alkylphenols, alkyl acids, resin acids, glycerol esters, sorbitan esters, amides, amines, fats, waxes, and oils.

Higher alkylene oxides are themselves hydrophobic, and therefore when copolymerized with EO the resulting polymers have surfactant properties without the need of additional hydrophobic groups. Therefore copolymers of EO/AO also fall within the scope of this invention.

A preferred class of EO/AO-surfactants is shown in formula 2, where $EO_X/AO_Y$ is random or in blocks starting and ending in either EO or AO. R1 is a C1-C20 linear or branched alcohol, acid, or alkylphenol. R2 is hydrogen or C1-C20 alkyl group. X and Y are such that the hydrophobe/lipophobe balance (HLB) of the surfactant is from about 2 to 18.

$$R1\text{-}(EO_X/AO_Y)\text{-}R2 \qquad \text{Formula 2}$$

In one embodiment of the invention the surfactant in formula 2 is an alcohol alkoxylate such that R1 is a C3-18 branched or linear alcohol, R2 is hydrogen or C1-C6 alkyl group, and AO represents repeating units of propylene oxide (PO). Preferably X and Y are such that the hydrophil lipophobe balance (HLB) of the alcohol alkoxylate ranges from about 7 to 16. Alcohol alkoxylates within this class are commercially available from BASF Corporation as Plurafac® LF- and RA-series and Pluracol® W-series; from Huntsman Corporation as Surfonic® LF-series; and from the Dow Chemical Company as Tergitol® Min-Foam and X-series. Examples of particularly preferred alcohol alkoxylates include Surfonic® LF17 a primary alcohol EO/PO with HLB of 12.2 and Tergitol® XD an EO/PO ether of butyl alcohol with an HLB of 13 to 14 and a molecular weight of 2990.

Another preferred class of EO/AO-surfactants is polydimethyl siloxane modified with EO/AO chains pendent to the polymer, in blocks within the silicone polymer, or terminating the silicone polymer at one or both ends. Preferably the polyethers are EO/PO and are pendent to the silicone chain. Most preferably modified polysiloxane surfactants have the structure shown in formula 3 where A is -R1-O-(EO/PO)-R2, where R1 is a C1-C6 alkyl group, and R2 is hydrogen or a C1-C6 alkyl group. The EO/PO ratio is between 10/90 and 90/10 and X and Y are such that the molecular weight is about 6000 to 35000.

Formula 3

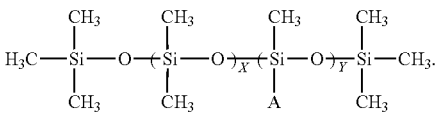

Preferably the EO/PO ratio in formula 3 is from about 30/70 to 70/30, R1 is C3, and R2 is hydrogen or C1-C4. Such polymers are available from GE Silicones under the trade name of Silwet®. Examples of particularly preferred polydimethyl siloxanes with pendent EO/PO polyether chains include Silwet® L-7230 with a molecular weight of 29000 and a polyether chain having EO/PO ratio of 40/60 and terminating in hydrogen and Silwet® L-7001 with 20000 molecular weight and 40/60 EO/PO terminating in methyl.

Another preferred class of EO/AO-surfactants are copolymers in which EO and AO are in specific blocks, not randomly distributed within the polyoxyalkylene chain. Surfactants within this class can have structures of R1-EO-AO-R2, R1-AO-EO-R2, R1-EO-AO-EO-R2, or R1-AO-EO-AO-R2. R1 and R2 represent hydroxyl and hydrogen, respectively, and/or R1 and R2 can be a C1-C20 acid or alcohol to produce mono- or di-ester or ether links with the EO/AO block copolymer. Preferably the higher alkylene oxide units are PO. Most preferably the block copolymers have the structure EO-PO-EO as shown in Formula 4.

Formula 4

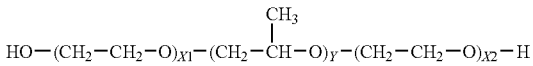

In formula 4, X1 and X2 can be the same or different, and X and Y are such that the percent EO ranges from about 10 to 80% of the polymer and such that the molecular weight of the block copolymer is from about 1000 to 13000. Most preferably EO makes up 40 to 70% of the polymer. Most preferably the molecular weight of the block copolymer is 3000 to 8000. Formula 4 polymers are available from BASF under the tradename of Pluronic®. Examples of particularly preferred EO-PO-EO block copolymers include Pluronic® P84 with 40% EO, HLB of 14 and molecular weight of 4200 and Pluronic® F87 with 70% EO, HLB 24, and 7700 molecular weight.

Another preferred class of EO/AO surfactants are alkylenediamine tetra functional EO/AO copolymers. Preferably the AO groups are PO and EO/PO are in blocks. Most preferably the tetra functional EO/AO surfactant is an ethylenediamine EO/PO block copolymer of formula 5.

Formula 5

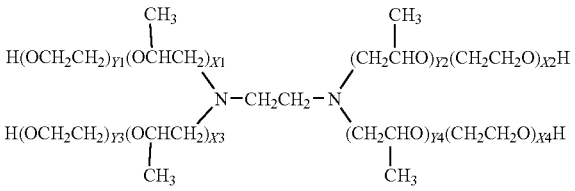

In formula 5, the X's and Y's are such that the percent EO in the polymer is from about 5 to 80% and the molecular weight of the polymer is from about 1600 to about 30000. X1-X4 can be the same or different and Y1-Y4 can be the same or different. Preferably EO makes up 10 to 50% of the polymer and the molecular weight is from about 3000 to about 10000. Such polymers are available from BASF under the tradename Tetronic®. Examples of a particularly preferred ethylenediamine tetra EO/PO block copolymers include Tetronic® 701 with 10% EO, HLB of 3, and molecular weight of 3600 and Tetronic® 904 40% EO, 15 HLB, and 6700 molecular weight.

It has surprisingly been found that anionic dispersants and/or sequestering agents can improve the ability of EO/AO-surfactants to passivate surfaces to prevent deposition. Suitable dispersants and/or sequestering agents include acrylic acid polymers, maleic anhydride polymers, lignosulfonates, naphthalene sulfonates, polyphosphates, phosphonates, gluconic acid, tartaric acid, citric acid, and ethylenediamine tetraacetic acid. The most preferred anionic dispersant and/or sequestering agents are citric acid, tartaric acid, and lignosulfonate.

The EO/AO-surfactants and/or compositions of the invention can be applied to the felt and/or equipment surface in any way such that the quantity on or within the felt or equipment surface is sufficient to produce the desired effect of controlling deposition on the equipment surface and/or within the felt structure. The compositions of the invention are applied in an amount effective to control deposition on the equipment surface and/or within the felt structure. For example the compositions can be sprayed, brushed, rolled, or puddled directly on the felt or equipment surface. The compositions can be applied to the felt such that the treatment will transfer to other equipment surfaces that come into contact with the felt, such as the uhle box. The compositions can also be applied to the other equipment surfaces, such as the felt carrier rolls, with the intention that the compositions will transfer to the felt surface. A portion of the felt can be immersed within a solution of the composition, such as by passing it through a vat containing the composition during the felt return stage so that the composition is absorbed on or into the felt as the felt passes through the vat. The compositions can be applied at any time to the felt as it rotates in a belt-like fashion between sheet contact stages and return stages. The compositions can also be added to the paper stock system either before the paper web is made or applied to the web just prior to it contacting the felt or equipment surface. In this manner the EO/AO-surfactant compositions transfer to the felt or equipment surface with the sheet water. In any of these methods, the EO/AO-surfactants and/or compositions of the invention can be applied neat (undiluted) or diluted in a solvent/carrier system.

The preferred method of applying the compositions of the invention to the press section would be to use any of the various aqueous low and/or high pressure cleaning or lubrication showers that are commonly used on the machine side and/or sheet side of the felt. The aqueous showers can be applied to the felt at a rate of about 0.01 to about 0.20 gallons per minute per inch width of felt. Preferably the concentration of the EO/AO-surfactants within the aqueous shower is from about 1 ppm to 10000 ppm, more preferably the concentration of the EO/AO-surfactants within the aqueous shower is from about 10 ppm to 2000 ppm.

The composition of the invention can be used to treat other equipment surfaces in the papermaking or paper converting processes where deposition prevention is also important. Examples of such equipment surfaces include lump-breaker rolls, couch rolls, calender rolls, dryer cans, doctor blades, dryer fabrics, fabric carrier rolls, corrugating fluting rolls and printing presses. The composition can be applied to such surfaces using aqueous showers similar to the method described for the press section. A preferred method of applying the EO/AO-surfactant compositions to these surfaces, particularly, those in the dry or converting sections would be to apply the compositions to the papermaking equipment surfaces undiluted using an atomized mist spray system.

EXAMPLES

The invention is illustrated in the following examples, which are provided for the purpose of representation, and are not to be construed as limiting the scope of the invention.

Performance was measured using two different methods. The first method was used to measure the ability of a conditioner to act on equipment surfaces in such a manner as to prevent deposition from building on the surface, referred to here as passivation of the surface. Test Apparatus A was used to measure surface passivation. The second method was used to measure the ability of a conditioner to act primarily on the contaminant to prevent press felt filling as measured by felt weight gain and air porosity loss of new felts exposed to various contaminant systems using Test Apparatus B.

Test Apparatus A consists of a felt loop that rotates between a contaminant solution and vacuum element (uhle box) that is in contact with the felt and pulls contaminant from the felt. A weighable deposit forms on the cover of the uhle box by frictional transfer from the felt to the cover. Conditioners are applied in a lubrication shower directed at the felt just as it enters the uhle box. The flow rate of contaminant out of the vacuum element is higher than the flow rate of the shower water to minimize treatment transfer back to the contaminant solution. In this manner it can be assumed that the treatment is acting on the cover surface to control deposition rather than reducing deposition by some other mechanism such as stabilizing the contaminant. High values for percent control of deposition indicate effective treatments. Percent control is the percent decrease in the treated sample as compared to that of untreated runs where the lubrication shower water contained no treatment other than water. Tests were run at 50° C. for 30 minutes.

Test Apparatus B is composed of a pneumatically driven piston and alternating centrifugal pumps that feed contaminant and product into a piston chamber which are pressed through new felt samples held within the chamber. Each up/down stroke of the piston completes a cycle and a set number of cycles completes a test run. After drying, measurements are made to determine the weight gained and porosity lost (measured using a Frazier Air Porosimeter) by the felt samples and used to indicate the ability of the treatment to maintain the fabric in its original condition. Lower values for percent weight gain and percent air porosity loss relative to untreated results are indications of cleaner felts and effective treatments. Tests were run at 50° C. for 250 piston cycles.

The commercially available felt conditioners, EO-surfactants, and EO/AO-surfactants referenced in the examples are described in Tables 1 through 3.

TABLE 1

Commercially Available Felt Conditioning Products* Used in Examples

| | Description |
|---|---|
| FC1 | Aqueous blend of nonylphenol ethoxylate, lignosulfonate and glycol ether |
| FC2 | Aqueous blend of alcohol ethoxylate, citric acid and glycol ether |
| FC3 | Non-aqueous blend of Alcohol ethoxylate, fatty acid and petroleum distillate |
| FC4 | Aqueous blend of alcohol ethoxylate, phosphate ester and polyamine |

*Available from Hercules Inc., Wilmington, DE, under the trade name Presstige ®

TABLE 2

EO-Surfactants Used in Examples

| Identification | Description |
|---|---|
| E1 | Branched alcohol ethoxylate (C13, 6 EO, HLB 11.2) |
| E2 | Branched alcohol ethoxylate (C13, 12 EO, HLB 14.4) |
| E3 | Linear alcohol ethoxylate (C12–14, 7 EO, HLB 11.9) |
| E4 | Linear alcohol ethoxylate (C12–14, 12 EO, HLB 14.4) |
| E5 | Castor oil ethoxylate (25 EO, HLB 10.8) |
| E6 | Castor oil ethoxylate (30 EO, HLB 11.7) |
| E7 | Castor oil ethoxylate (36 EO, HLB 12.5) |
| E8 | Castor oil ethoxylate (40 EO, HLB 13.6) |
| E9 | Ethoxylated sorbitan monolaurate (20 EO, HLB 16.7) |
| E10 | Ethoxylated sorbitan monooleate (20 EO, HLB 15) |
| E11 | Ethoxylated sorbitan monostearate (20 EO, HLB 14.9) |
| E12 | Ethoxylated ether of glyceryl monococoate (30 EO, HLB 15.9) |
| E13 | Polydimethyl siloxane ethoxylate (low HLB, MW 600) |
| E14 | Polydimethyl siloxane ethoxylate (low HLB, MW 3000) |
| E15 | Polydimethyl siloxane ethoxylate (high HLB, MW 4000) |
| E16 | Polydimethyl siloxane ethoxylate (high HLB, MW 6000) |

TABLE 3

EO/AO-Surfactant Used in Examples

| Identi-fication | Description |
|---|---|
| P1 | Butyl alcohol EO/PO (EO/PO ratio 27/24, HLB 13–14) |
| P2 | Butyl alcohol EO/PO (EO/PO ratio 35/28) |
| P3 | Butyl alcohol EO/PO (EO/PO ratio 45/33) |
| P4 | Primary alcohol EO/PO (HLB 7) |
| P5 | Primary alcohol EO/PO (HLB 12.2) |
| P6 | Ethylenediamine tetra EO/PO (10% EO, HLB 3, MW 3600) |
| P7 | Ethylenediamine tetra EO/PO (40% EO, HLB 15, MW 5500) |
| P8 | Ethylenediamine tetra EO/PO (40% EO, HLB 15, MW 6700) |
| P9 | EO-PO-EO block copolymer (20% EO, HLB 7, MW 2500) |
| P10 | EO-PO-EO block copolymer (40% EO, HLB 15, MW 2900) |
| P11 | EO-PO-EO block copolymer (40% EO, HLB 14, MW 4200) |
| P12 | EO-PO-EO block copolymer (50% EO, HLB 16, MW 4600) |
| P13 | EO-PO-EO block copolymer (70% EO, HLB 24, MW 7700) |
| P14 | EO-PO-EO block copolymer (80% EO, HLB 29, MW 8400) |
| P15 | EO-PO-EO block copolymer (80% EO, HLB 27, MW 14600) |
| P16 | Polydimethyl siloxane 40/60 EO/PO methyl cap, MW 20000 |
| P17 | Polydimethyl siloxane 40/60 EO/PO hydrogen cap, MW 29000 |
| P18 | Polydimethyl siloxane 75/25 EO/PO hydrogen cap, MW 19000 |

Example 1

Apparatus A was used to evaluate the effectiveness of different surfactants at passivating a surface to prevent deposition. For this study a synthetic pitch was used that contained pine stump rosin, tall oil fatty acids, and vegetable oil blended in a ratio that would be typical of the resin acid, fatty acid, and fatty triglyceride content in mechanical pine pitch. The pitch was added to a synthetic white water system containing alum, sodium silicate, calcium chloride, magnesium sulfate, and sodium sulfate in a ratio typical of the inorganic components that would be found in acid newsprint systems. The treatments were applied to the uhle surface through the lubrication shower. The dosages shown are relative to the contaminant system volume. The surfactants, all about 100% active, were compared to 3 commercially available felt conditioners FC1 (~50% actives), FC3 (~100% active) and FC4 (~20% active). The results are shown in Table 4.

TABLE 4

Surface Passivation using Surfactants

| | Percent Control of Deposition Product Dosage | | | |
|---|---|---|---|---|
| Identification | 25 ppm | 50 ppm | 100 ppm | 200 ppm |
| E1 | | 28 | | |
| E2 | | 64 | | |
| E3 | | 54 | | |
| E4 | 31 | 71 | | |
| E5 | | 18 | | |
| E6 | | 79 | 92 | |
| E7 | | 21 | | |
| E8 | | 40 | | |
| E9 | | 37 | | |
| E10 | | 54 | | |
| E11 | | 70 | | |
| E12 | | 33 | | |
| E13 | | 20 | | |
| E14 | | 74 | 97 | |
| E15 | | 36 | | |
| E16 | | 34 | | |
| P1 | 84 | 94 | | |
| P6 | 71 | 97 | | |
| P7 | 57 | 98 | | |
| P8 | 86 | 95 | | |
| P9 | | 75 | 84 | |
| P10 | 54 | 90 | | |
| P12 | 53 | 93 | | |
| P13 | 66 | 85 | 96 | |
| P14 | | 80 | 99 | |
| P15 | | 37 | | |
| P16 | | 82 | | |
| P17 | 84 | 97 | | |
| P18 | | 53 | | |
| FC1 | | 14 | 56 | 75 |
| FC3 | | 27 | 42 | 76 |
| FC4 | | 8 | 21 | 51 |

The data in Table 4 show that the EO/AO-surfactants as a class are significantly more effective than EO-surfactants for passivating equipment surfaces to prevent deposition. The EO/AO-surfactants are also significantly more effective than the commercially available felt conditioners based on EO-surfactants, even when taking into account the difference in active content. EO/AO-surfactants that were particularly effective included alcohol EO/PO (P1), ethylene diamine tetra EO/PO (P6-P8), EO-PO-EO block copolymers (P10, P12-14), and polydimethyl siloxane EO/PO surfactants (P16, P17). The data in Table 4 demonstrates that EO-PO-EO block copolymers are not as effective at high molecular weight above about 10000 (P15), but that they are effective over a wide EO range 10-80%.

Example 2

A study was conducted to compare the passivation performance of different compositions of nonionic surfactants containing at least one EO/AO-surfactant. The study was conducted using the same test apparatus and contaminant system described in Example 1 except the system additionally contained filtrate from thermal mechanical pulp filtered through a wire mesh to add some lignin and hemicellulose components typical of what would be contained in a newsprint system at the felt. The percent by weight of the compositions is given in Table 5. The compositions all contained 30% surfactant for comparison purposes. This concentration was arbitrary; any concentration that produced a stable liquid product capable of being pumped to a system would be acceptable. The percent control of deposition when applying 100 ppm of the composition directly to the surface through the water shower are shown in Table 5.

TABLE 5

Passivation Results with EO/AO-Surfactant Compositions

| ID | Composition, % by Weight (balance equals water) | % Control 100 ppm |
|---|---|---|
| A | 15% P1 + 15% P6 | 76 |
| B | 15% P1 + 3.75% P6 + 11.25% P15 | 56 |
| C | 15% P1 + 15% E4 | 60 |
| D | 15% P6 + 15% E4 | 45 |
| E | 10% P10 + 20% E4 | 65 |
| F | 10% P14 + 20% E4 | 69 |
| G | 10% P15 + 20% E4 | 42 |
| H | 9.5% P6 + 5.5% P17 + 15% E4 | 72 |
| I | 5% P17 + 25% E4 | 58 |

The data in Table 5 show that compositions containing at least one EO/AO-surfactant can passivate the test surface to prevent deposition. The data also show that composition "A" containing alcohol EO/PO (P1) with ethylenediamine tetra EO/PO (P6) are effective.

Example 3

A study was conducted using the same method and contaminant system described in Example 2 to determine the impact of an anionic dispersant and/or sequestering agent on formulations containing at least one EO/AO-surfactant. The percent by weight of each component in the compositions and the percent deposition control when applying 100 ppm of the compositions to the equipment surface through the water shower are shown in Table 6.

TABLE 6

Surface Passivation using Compositions

| Composition, % by Weight (balance equals water) | % Control 100 ppm |
|---|---|
| 15% P1 + 15% E4 | 60 |
| 15% P1 + 15% E4 + 10% Citric Acid | 69 |
| 15% P6 + 15% E4 | 45 |
| 15% P6 + 15% E4 + 10% Citric Acid | 72 |
| 10% P14 + 20% E4 | 69 |
| 10% P14 + 20% E4 + 10% Citric Acid | 72 |
| 10% P14 + 20% E4 + 20% Citric Acid | 75 |

TABLE 6-continued

Surface Passivation using Compositions

| Composition, % by Weight (balance equals water) | % Control 100 ppm |
|---|---|
| 15% P1 + 15% P6 | 76 |
| 15% P1 + 15% P6 + 10% Lignosulfonate | 89 |
| 15% P1 + 15% P6 + 10% Citric Acid | 85 |
| 15% P1 + 15% P6 + 20% Citric Acid | 94 |
| 15% P1 + 15% P6 + 20% Tartaric Acid | 94 |
| 15% P1 + 3.75% P6 + 11.25% P15 | 56 |
| 15% P1 + 3.75% P6 + 11.25% P15 + 10% Citric Acid | 68 |

Dispersants and sequestering agents such as lignosulfonate, citric acid and tartaric acid were not effective relative to surfactants for passivating surfaces; at 50 ppm actives they provided only 3 to 30% control of deposition. The data in Table 6 demonstrate the unexpected improvement in passivation by the addition of an anionic dispersant and/or sequestering agent to the formulations containing at least one EO/AO-surfactant. In these experiments only 10 to 20 ppm of the dispersant would be present, yet there was always an improvement in control compared with the compositions not containing the anionic component. The data in Table 6 also show that compositions based on alcohol EO/PO (P1), ethylenediamine tetra EO/PO (P6), and lignosulfonate, citric acid, or tartaric acid were effective for passivating the equipment surface.

Example 4

A study was conducted to compare the performance of compositions containing at least one EO/AO-surfactant and 10-15% dispersant with similar compositions that were based on EO-surfactants. The study was conducted in the same manner as in Example 2. The results are contained in Table 7.

TABLE 7

Passivation Results with Compositions Containing about 10 to 15% Anionic

| ID | Composition, % by Weight (balance equals water) | % Control of Deposition 50 ppm | 100 ppm | 200 ppm |
|---|---|---|---|---|
| | Compositions Based on EO-Surfactants | | | |
| | Commercial Product FC1 (~50% actives) | 3 | 65 | 71 |
| | Commercial Product FC2 (~50% actives) | 3 | 64 | 76 |
| J | 30% E4 + 10% citric acid | | 37 | |
| | Compositions Based on EO/AO-Surfactants | | | |
| K | 30% P1 + 10% citric acid | | 77 | |
| | 30% P2 + 10% citric acid | | 57 | |
| | 30% P3 + 10% citric acid | | 72 | |
| L | 30% P11 + 10% citric acid | 37 | 93 | 99 |
| M | 15% P1 + 15% P6 + 10% citric acid | | 85 | |
| N | 15% P1 + 15% P6 + 10% lignosulfonate | | 89 | |
| | 10% P1 + 20% P6 + 10% citric acid | | 88 | |
| | 20% P1 + 10% P6 + 10% citric acid | | 73 | |
| O | 15% P1 + 3.75% P6 + 11.25% P15 + 10% citric acid | | 68 | |
| | 15% P1 + 15% P9 + 10% citric acid | | 65 | |

TABLE 7-continued

| Passivation Results with Compositions Containing about 10 to 15% Anionic | | | |
|---|---|---|---|
| | | % Control of Deposition | |
| ID | Composition, % by Weight (balance equals water) | 50 ppm | 100 ppm | 200 ppm |
| P | 15% P6 + 15% P11 + 10% citric acid | | 88 | 97 |
| | 15% P6 + 15% P15 + 10% citric acid | | 61 | |
| Q | 15% P1 + 15% E4 + 10% citric acid | | 69 | |
| R | 15% P6 + 15% E4 + 10% citric acid | | 72 | |
| | 25% P6 + 5% E4 + 10% citric acid | | 74 | |
| | 10% P1 + 10% P6 + 10% E4 + 10% citric acid | | 62 | |
| | 12.5% P1 + 12.5% P6 + 5% E4 + 10% citric acid | | 81 | |
| S | 10% P14 + 20% E4 + 10% citric acid | | 72 | |
| T | 20% P14 + 10% E4 + 10% citric acid | | 72 | |

The results in Table 7 demonstrate that compositions containing anionic dispersant and at least one EO/AO-surfactant are generally more effective than compositions based on EO-surfactants. Table 7 also demonstrates that compositions "L" and "P" containing EO-PO-EO block copolymers with molecular weights between about 3000 and 8000 were effective. Compositions containing alcohol EO/PO (P1) and ethylenediamine tetra EO/PO (P6) were also effective, such as in compositions "M" and "N".

Example 5

A study was conducted in the same manner as in Example 4 however the compositions contained a higher level of anionic dispersant. The results are contained in Table 8.

TABLE 8

| Passivation Results with Compositions Containing 20 to 25% Anionic | | | |
|---|---|---|---|
| | | % Control of Deposition | |
| ID | Composition, % by Weight (balance equals water) | 50 ppm | 100 ppm | 200 ppm |
| | Compositions Based on EO Surfactants | | | |
| U | 30% E4 + 20% citric acid | | 71 | |
| | Compositions Based on EO/AO Surfactants | | | |
| | 15% P1 + 15% P4 + 20% citric acid | | 79 | |
| V | 15% P1 + 15% P6 + 20% citric acid | 74 | 94 | 97 |
| | 15% P1 + 15% P6 + 20% tartaric acid | | 94 | |
| | 15% P6 + 15% P2 + 20% citric acid | | 83 | |
| W | 15% P6 + 15% P5 + 20% citric acid | | 96 | |
| X | 15% P6 + 15% P12 + 20% citric acid | 16 | 91 | 99 |
| Y | 15% P6 + 15% P14 + 20% citric acid | | 83 | |
| Z | 10% P14 + 20% E4 + 20% citric acid | 1 | 75 | 96 |
| | 20% P14 + 10% E4 + 20% citric acid | | 74 | |
| | 10% P1 + 10% P6 + 10% E4 + 25% citric acid | | 78 | |

The results in Table 8 show that compositions containing anionic dispersant and at least one EO/AO-surfactant are more effective at passivating surfaces than compositions based on EO-surfactants. The data in Table 8 demonstrate that compositions containing combinations of alcohol EO/PO (P1, P2, P5), ethylenediamine tetra EO/PO (P6), and citric acid or tartaric acid were effective, such as compositions "V" and "W". The data also shows that compositions containing ethylenediamine tetra EO/PO and EO-PO-EO block copolymers were also effective, compositions "X" and "Y".

Example 6

A study was conducted to determine the effect that compositions identified in the previous examples Tables 5, 7, 8 would have on felt filling. Apparatus B was used for this study with the same pitch, white water, and TMP filtrate system described in Example 2. The results for the weight gained and porosity lost by the felt samples as a result of being subjected to the contaminant system is shown in Table 9. Effective compositions lower the results compared to those of the untreated felts which had on average 7.7% weight gain and 55% porosity loss.

TABLE 9

| Felt Filling Results | | | | | | |
|---|---|---|---|---|---|---|
| | Percent Weight Gain | | | Percent Porosity Loss | | |
| Untreated | 7.7% | | | 55% | | |
| Composition Identified in Tables 5, 7, 8 | 100 ppm | 200 ppm | 400 ppm | 100 ppm | 200 ppm | 400 ppm |
| EO/AO, 0% anionic | | | | | | |
| A | | 2.3 | | | 29 | |
| B | | 3.1 | | | 28 | |
| C | | 2.3 | | | 27 | |
| D | | 3.1 | | | 32 | |
| E | | 2.5 | | | 30 | |
| F | | 3.1 | | | 38 | |
| G | | 2.5 | | | 28 | |

TABLE 9-continued

| | | Felt Filling Results | | | | |
|---|---|---|---|---|---|---|
| H | | 7.4 | | | 50 | |
| I | | 3.9 | | | 43 | |
| EO, 10–15% anionic | | | | | | |
| FC1 | 7.2 | 4.3 | 2.2 | 45 | 36 | 17 |
| FC2 | 9.8 | 7.4 | 4.2 | 46 | 46 | 37 |
| J | | 4.7 | | | 28 | |
| EO/AO, 10–15% anionic | | | | | | |
| K | | 2.7 | | | 30 | |
| L | | 4.2 | | | 31 | |
| M | | 2.2 | | | 29 | |
| N | | 4.8 | | | 37 | |
| O | | 2.1 | | | 28 | |
| P | 3.7 | 3.4 | 1.5 | 35 | 24 | 19 |
| Q | | 1.9 | | | 28 | |
| R | | 5.3 | | | 46 | |
| S | | 2.6 | | | 31 | |
| T | | 2.3 | | | 30 | |
| EO, 20–25% anionic | | | | | | |
| U | | 6.9 | | | 52 | |
| EO/AO, 20–25% anionic | | | | | | |
| V | 6.0 | 4.0 | 2.4 | 41 | 26 | 20 |
| W | | 5.4 | | | 41 | |
| X | 3.5 | 3.4 | | 38 | 20 | |
| Y | | 5.7 | | | 49 | |
| Z | | 5.2 | | | 38 | |

The results in Table 9 show that compositions containing EO/AO-surfactants performed at least as well as EO-surfactant compositions. These results along with the results from the previous examples, illustrate that there is a clear difference in controlling felt filling and passivating equipment surfaces. EO/AO-surfactant compositions significantly improve control of deposition on equipment surfaces (previous examples) while controlling felt filling at least as well as EO-containing products.

Example 7

A study was conducted to compare surface passivation and felt filling results using a different contaminant system typical of that that would be found in a mill using deinked secondary fiber as a portion of the fiber furnish. For this study the synthetic test system contained models for ink and flotation aid contaminants in addition to the pitch and white water components described in Example 1. The results are contained in Table 10.

The data in Table 10 show that compositions containing citric acid and ethylenediamine EO/PO with either an alcohol EO/PO or an EO-PO-EO block copolymer are superior to commercial products based on dispersant and EO-surfactants.

The invention claimed is:

1. A method for inhibiting substances from filling or forming deposits on or within papermaking felts and on papermaking equipment surfaces by applying to said felt or equipment surface an effective inhibiting amount of a composition containing one or more nonionic polyoxyalkylene surfactants in which the polyoxyalkylene chains contain repeating units of both ethylene oxide (EO) and of a higher alkylene oxide (AO).

2. The method of claim 1 wherein the EO units and AO units repeat randomly or are in blocks within polyoxyalkylene chain.

TABLE 10

Surface Passivation and Felt Filling Results

| | Surface Passivation | | | Felt Filling | | | |
|---|---|---|---|---|---|---|---|
| | % Control of Deposition | | | % Weight Gain | | % Porosity Loss | |
| Untreated | 0% | | | 7.1% | | 54% | |
| Composition | 50 ppm | 100 ppm | 200 ppm | 200 ppm | 400 ppm | 200 ppm | 400 ppm |
| FC1 | −6 | 46 | 64 | 6.0 | 3.1 | 49 | 48 |
| FC2 | 14 | 59 | 87 | 6.7 | 7.6 | 55 | 64 |
| P | 67 | 89 | 94 | 5.5 | 2.1 | 56 | 27 |
| V | 76 | 96 | 96 | 5.7 | 2.8 | 57 | 28 |
| X | 67 | 90 | 96 | 4.0 | 1.8 | 47 | 20 |

3. The method of claim 1 wherein the AO repeating units have at least one $C_1$-$C_6$ alkyl or cyclic groups pendent to the chain per AO repeating unit.

4. The method of claim 1 wherein the AD repeating units chosen from of propylene oxide (PO) or butylene oxide (BO).

5. The method of claim 1 wherein EO/AO-surfactent contains one or more EO/AO chains per molecule.

6. A method for inhibiting substances from filling or forming deposits on or within papermaking felts and on papermaking equipment surfaces by applying to said felt or equipment surface en effective inhibiting amount of a composition comprising (a) one or more anionic dispersants and/or sequestering agents and (b) one or more nonionic EO/AO-surfactants.

7. A method for Inhibiting substances from filling or forming deposits on or within papermaking felts and on papermaking equipment surfaces by applying to said felt or equipment surface an effective inhibiting amount of a composition being comprised of 1-50% ethylenediamine tetra EO/PO, copolymers 1-50% of an alcohol EO/PO and/or en EO-PO-EO block copolymer, and 0-30% of one or more anionic dispersants and/or sequestering agents, applied to the felt and/or equipment surface within an aqueous shower in which the concentration of EO/PO surfactants using the shower is from about 1ppm to about 2000ppm.

8. The method of claim 1 wherein the composition is applied to said equipment felt through equipment showers at a rate of about 0.01 to about 0.20 gallons per minute.

* * * * *